United States Patent [19]

Takamatsu

[11] 4,000,545

[45] Jan. 4, 1977

[54] SLIDE FASTENER WITH EMERGENCY OPENING MEANS

[75] Inventor: Ikuo Takamatsu, Uozu, Japan

[73] Assignee: Yoshida Kogyo Kabushiki Kaisha, Japan

[22] Filed: Oct. 16, 1975

[21] Appl. No.: 623,262

[30] Foreign Application Priority Data

Oct. 22, 1974 Japan ..... 49-121742

[52] U.S. Cl. ..... 24/205 R

[51] Int. Cl.[2] ..... A44G 19/00

[58] Field of Search ..... 24/205 R; 2/69.5; 5/343, 150

[56] References Cited

UNITED STATES PATENTS

| | | | |
|---|---|---|---|
| 2,084,593 | 6/1937 | Pickens | 24/205 R |
| 3,122,808 | 3/1964 | Maschi | 24/205 R |
| 3,540,090 | 11/1970 | Takamatsu | 24/205 R |
| 3,731,349 | 5/1973 | Terada | 24/205 R |

FOREIGN PATENTS OR APPLICATIONS

| | | | |
|---|---|---|---|
| 558,341 | 6/1958 | Canada | 24/205 R |
| 69,816 | 12/1958 | France | 24/205 R |
| 1,918,379 | 10/1970 | Germany | 24/205 R |

*Primary Examiner*—Bernard A. Gelak
*Attorney, Agent, or Firm*—Bucknam and Archer

[57] ABSTRACT

A slide fastener capable of being forced open in an emergency without manipulating a slider along interlocking rows of scoops. The slide fastener comprises an emergency opening zone at its intermediate point where the rows of scoops are incapable of interlocking engagement when the fastener is closed, and a pair of rigid reinforcements fixedly arranged along and on the opposite sides of the zone. Each reinforcement extends beyond both extremities of the zone, so that the fastener will not open accidentally from the zone but will open unfailingly upon application of a finger pressure to the zone in an emergency.

4 Claims, 11 Drawing Figures

SLIDE FASTENER WITH EMERGENCY OPENING MEANS

BACKGROUND OF THE INVENTION

This invention relates generally to slide fasteners and is more specifically directed to improvements in or relating to a slide fastener of the type having an emergency opening zone at its intermediate point such that, in an emergency, the fastener can be manually forced open from the zone without need for pulling the slider along the interlocking rows of fastener elements or scoops.

The slide fasteners of the above described type find advantageous use with emergency exits or other closure openings in tents, curtains and like articles. In the event of an emergency such as a fire or earthquake, a finger pressure is to be applied to the emergency opening zone located intermediate both ends of the interlocking rows of scoops, and the fastener is readily openable from the zone by then manually spreading its stringers apart. There is no time wasted in manipulating the slider all along the rows of scoops.

The conventional emergency opening means, however, consists solely of the noted emergency opening zone in which several scoops are nonexistent on each stringer tape and from which the fastener is meant to be forced open in emergencies. The rows of scoops of the fastener, when interengaged by the slider movable therealong, are highly susceptible to disengagement from the zone. The fastener is therefore easy to open accidentally when, in its normal use, a slight transverse pull is exerted on the zone via the article to which the fastener is attached. Unless this vital defect is remedied, the true practical utility of the slide fasteners with the emergency opening means cannot be established.

SUMMARY OF THE INVENTION

It is an object of this invention to provide a slide fastener having emergency opening means such that the fastener will not open accidentally in its normal use but can nevertheless be readily forced open in an emergency without manipulating its slider.

Briefly, the invention is directed to a slide fastener of the type having a pair of stringer tapes which carry along their opposed longitudinal edges interlockable rows of scoops of either discrete or continuous type. There are provided according to the invention an emergency opening zone which is located intermediate both ends of the rows of scoops and in which the rows of scoops are made incapable of interlocking engagement when the fastener is closed, and a pair of reinforcements of relatively rigid material fixedly arranged along and on the opposite sides of the emergency opening zone with spacings therefrom. Each reinforcement is longer than the emergency opening zone and extends beyond both extremities of the zone.

The pair of reinforcements are effective to hold the slide fastener closed in spite of a high transverse pull which may be exerted thereon at or in the adjacency of its emergency opening zone via an article to which the fastener is attached. Such reinforcements can be affixed either to the edges of the article bounding an opening therein or to the stringer tapes. The emergency opening zone can be formed either by removing several scoops from each stringer tape or by deforming several scoops on one or both stringer tapes so as to be essentially incapable of interlocking engagement when the fastener is closed by the slider.

The novel features which are considered characteristic of this invention are set forth in particular in the appended claims. The invention itself, however, both as to its construction and its mode of operation, together with additional objects and advantages thereof, will be best understood from the following description of specific embodiments, which is to be read in connection with the accompanying drawings in which like reference characters refer to like parts throughout.

DESCRIPTION OF THE PREFERRED EMBODIMENTS

Figure 1:
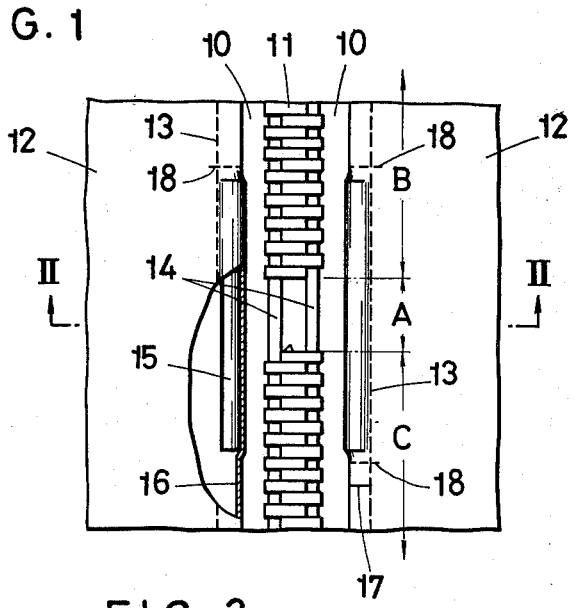
FIG. 1 is a fragmentary plan view of a slide fastener as attached to the edges of an article bounding a closure opening therein, in which one of the article edges is shown partly broken away to reveal one of the reinforcements used in the emergency opening means of the fastener according to this invention.
Figure 2:
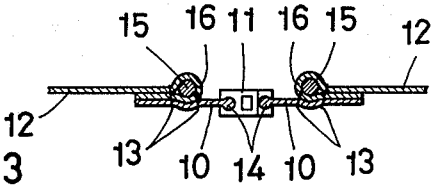
FIG. 2 is a transverse sectional view of the slide fastener taken along the plane of line II—II in FIG. 1.

With particular reference to FIGS. 1 and 2 the slide fastener illustrated therein by way of a first preferred embodiment of this invention includes a pair of stringer tapes 10 carrying interlockable rows of fastener elements or scoops 11 of the usual discrete type along their opposed longitudinal edges. These stringer tapes 10 are shown attached to the respective opposed edges of an article 12 such as a tent or curtain by means of dual rows of stitches 13. The slide fastener is thus adapted to openably close the opening bounded by the opposed edges of the article 12.

Shown at A in FIG. 1 is an emergency opening zone that is located intermediate both ends of the rows of scoops 11 and from which several scoops on each stringer tape 10 are absent. In this emergency opening zone, therefore, the two rows of scoops 11 are incapable of interlocking engagement when the slide fastener is closed by the usual slider, not shown, movable therealong. The capitals B and C in the drawing represent the remaining zones of the slide fastener where the scoops 11 interengage in the normal fashion upon movement of the unshown slider therealong in the fastener closing direction.

Since the emergency opening zone A in this particular embodiment of the invention is formed by the absence of several scoops on each stringer tape 10, the length of the zone should be such that the slider will not walk off the rows of scoops from that zone in the act of closing or opening the fastener. It is also desirable that a pair of edge beads 14 on the respective opposed edges of the stringer tapes 10 be of sufficient thickness and rigidity to constrain the slider to move therealong.

As an essential feature of this invention, a pair of reinforcements 15 of relatively rigid material are fixedly arranged along, and on the opposite sides of, the emergency opening zone A with suitable spacings therefrom. The reinforcements 15 in this first embodiment are each shown to be in the shape of a rod, which in practice may take the form of piano wire. Each reinforcement 15 should be longer than the emergency opening zone A and should extend beyond both extremities of that zone into the neighboring zones B and C.

Also in this particular embodiment of the invention, the reinforcements 15 are sewn respectively into rearward folds 16 formed along the opposed edges of the article 12. For thus sewing the reinforcements 15 into the respective folds 16, the reinforcements may be inserted into the folds from slits 17 formed therein. After arranging the reinforcements in prescribed positions within the folds with respect to the emergency opening zone A, they may be restrained from displacement by stitches 18 formed at both ends of each reinforcement.

It is worth mentioning that at least one of the two rows of stitches 13 by which each stringer tape 10 is secured to the fold 16 along the corresponding edge of the article 12 should be located immediately on the outside of the reinforcement 15 (that is, opposite to the side on which the scoops 11 are located) or thereabouts. This is to make sure that a transverse pull exerted on the article 12 when the fastener is held closed is transmitted to the interengaged scoops 11 via the reinforcements 15 and stringer tapes 10. It is also important to note that the reinforcements 15 must be suitably spaced from the rows of scoops 11 to permit the scoop-carrying edges of the stringer tapes 10 to move apart from each other for disengagement of the scoops in emergencies, as will more fully appear from the following description.

In the use of the slide fastener set forth hereinbefore with reference to FIGS. 1 and 2, a high transverse pull may be accidentally exerted on the article 12 in the adjacency of the emergency opening zone A in the normal working conditions of the fastener, while the fastener is held closed. Were it not for the reinforcements 15, as had been the case with the prior art, this transverse pull would act directly upon the emergency opening zone A thereby causing the rows of scoops 11 to disengage from the zone.

However, since the rigid reinforcements 15 on both sides of the emergency opening zone A extend into the neighboring zones B and C according to this invention, the transverse pull on the article 12 will act, via the reinforcements, upon the zones B and C as well, where the scoops 11 on both stringer tapes 10 are securely interengaged. The slide fastener according to the invention can thus be held closed in spite of the accidental transverse pull exerted on the article 12.

Figure 3:
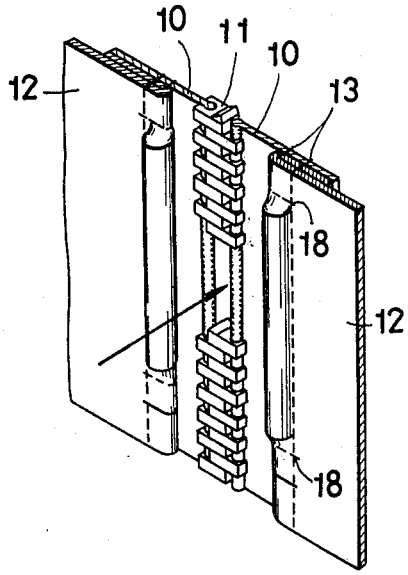
FIG. 3 is a fragmentary perspective view of the slide fastener of FIG. 1, the view being explanatory of the way the fastener is forced open in an emergency.
Figure 4:
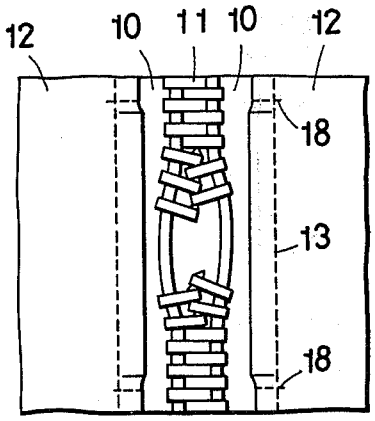
FIG. 4 is a fragmentary plan view also explanatory of the way the slide fastener of FIG. 1 is forced open in an emergency.

For opening the slide fastener in the event of an emergency, such for example as a fire or earthquake, a finger pressure may be applied to its emergency opening zone A in a direction normal to the plane of the fastener, as indicated by the arrow in FIG. 3. Even though the rigid reinforcements 15 are arranged on both sides of the emergency opening zone A, the stringer tapes 10 are sufficiently flexible to yield to the finger pressure and to move apart from each other, with their opposed edges curved arcuately as depicted in FIG. 4.

As the scoops 11 of the zones B and C are partly disengaged by the initial finger pressure applied to the emergency opening zone A, the pair of stringer tapes 10 may then be manually forced apart to cause complete disengagement of the scoops of the zones B and C. It is possible in this manner to quickly open the fastener from its emergency opening zone, without need for pulling the slider in the fastener opening direction all along the rows of scoops.

Figure 5A:
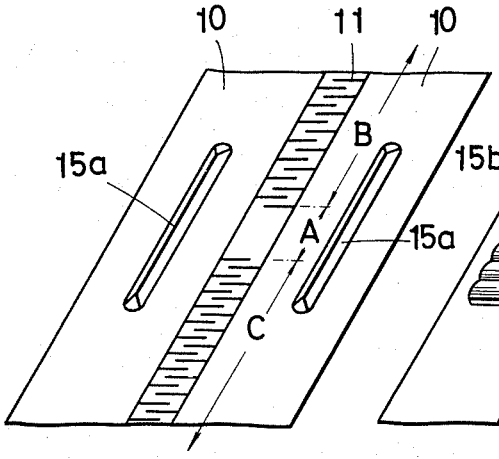
FIGS. 5A and 5B are fragmentary, schematic perspective views showing alternative forms of the reinforcements for use in the emergency opening means according to the invention.
Figure 5B:
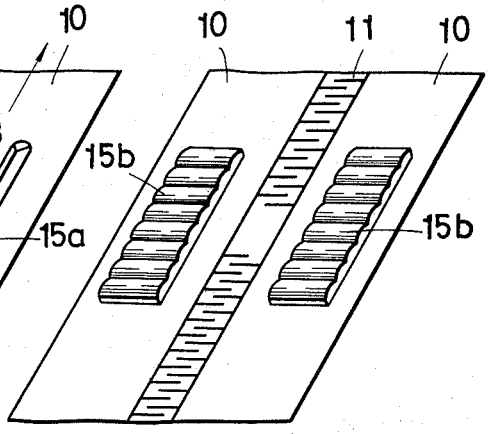

FIGS. 5A and 5B illustrate different examples of reinforcements to be arranged along, and on the opposite sides of, the emergency opening zone A in accordance with the invention. While in the preceding embodiment of the invention the reinforcements 15 are sewn into the respective rearward folds 16 formed along the opposed edges of the article, such reinforcements can be directly affixed to the front and/or rear surfaces of the stringer tapes 10 within the scope of the invention. The shape and material of the reinforcements are also not limited to the specific examples set forth in conjunction with FIGS. 1 and 2, only if each reinforcement is sufficiently rigid to resist bending in the transverse direction (normal to the direction in which the rows of scoops 11 extend) in spite of the forces encountered in the normal use of the slide fastener.

Shown in FIG. 5A is another example of reinforcements meeting such requirements. The illustrated reinforcements **15*a* are each rod-shaped, with a ridge extending throughout its length, and can be molded of a synthetic resin or the like. These reinforcements are mounted directly upon the respective stringer tapes 10.**

Reinforcements **15*b* shown in FIG. 5B by way of an additional example are each in the shape of a strip of a synthetic resin or the like with a series of scallops on one of its faces. The scalloped reinforcements 15*b*, also mounted directly upon the respective stringer tapes 10,** has the advantage that they do not impair the flexibility of the tapes in the direction normal to the tape plane.

The reinforcements **15*a* and 15*b* are both well calculated so as not to hamper the movement of the needle when the stringer tapes 10 are sewn onto the edges of a desired article. It should be noted that, in spite of the showing of the drawings, such reinforcements 15, 15*a* and 15*b*** may not necessarily be arranged one on each side of the emergency opening zone A, but that two or more reinforcements can be disposed in parallelism on each side of the zone.

FIGS. 6A to 6E are all directed to possible modifications of the emergency opening zone A which can be used in combination with the reinforcements **15, 15*a* or 15*b*** according to the invention. In all these modifications shown, the emergency opening zone is formed not by removing several scoops from each stringer tape but by deforming several scoops on one or both stringer tapes so as to be incapable of interlocking engagement when the fastener is closed by the slider.

Figure 6A:
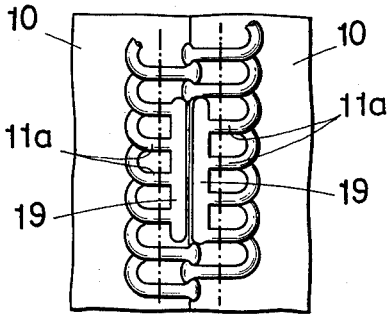
FIGS. 6A to 6E, inclusive, are fragmentary, schematic plan views showing various alternative forms of scoops which can be adopted to provide an emergency opening zone in this invention.

In FIG. 6A, for example, the coupling heads of several scoops **11*a* of the usual coil-type continuous coupling element on each stringer tape 10 are fused into a rod-shaped portion 19 extending across the several scoops. The pair of opposed rod-shaped portions 19** thus formed, which may be spaced some distance from each other, are of course incapable of interengagement when the fastener is closed.

Figure 6B:
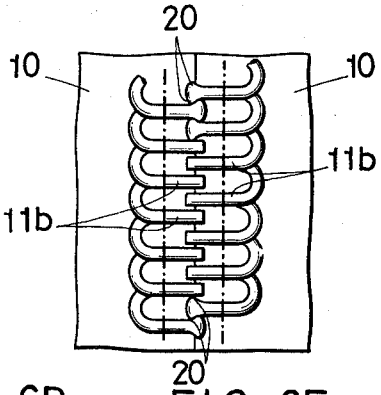

In FIG. 6B several scoops 11*b* of the coil-type coupling element on each stringer tape 10 have the usual lateral protuberances removed from, or not formed on, their coupling heads, the lateral protuberances on the other scoops being designated 20 in the drawing. Alternatively, the lateral protuberances of the several scoops 11*b* may be lessened in size to such an extent that the scoops will not substantially interlock upon closure of the fastener.

Figure 6C:
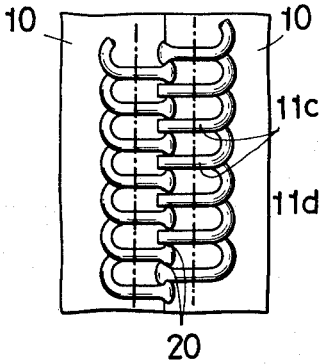

As illustrated in FIG. 6C, the lateral protuberances can be removed from the coupling heads of several scoops 11*c* of the coil-type coupling element only on one of the stringer tapes 10.

Figure 6D:
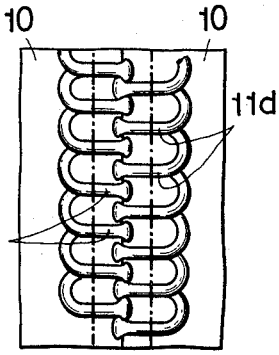

In FIG. 6D the spacings between several scoops 11*d* of the coil-type coupling element on each stringer tape 10 are made wider than the spacings between the scoops of other than the emergency opening zone A. Thus, when the fastener is closed by the slider, the scoops 11*d* of the emergency opening zone will interengage so loosely that the fastener is readily openable in an emergency in the manner previously explained in connection with FIGS. 3 and 4.

Figure 6E:
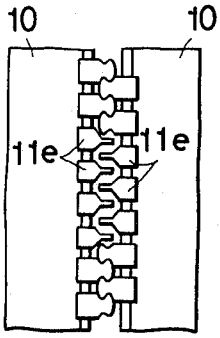

It will now be apparent that the concepts underlying all the preceding examples of the emergency opening zone A shown in FIGS. 6A to 6D are directly applicable to other injection-molded synthetic-resin coupling elements or to metal-made elements, as represented by scoops 11*e* given in FIG. 6E as an additional example.

The scoops 11*a* to 11*e* of FIGS. 6A to 6E have in common the advantage of producing little or no gap in the emergency opening zone A when the slide fastener is closed. All these deformed scoops are incapable of interlocking engagement in the emergency opening zone, as in the first described embodiment of the invention in which no scoops are present in the zone, so that fasteners incorporating such scoops can be forced open in an emergency just like the fastener of the first embodiment.

It is believed that the advantages of the slide fastener with the improved emergency opening means according to the invention are apparent from the foregoing detailed description. While some preferred forms of the invention have been shown and described, however, it will be understood that changes may be made in the structures disclosed, without departing from the spirit of the invention as sought to be defined in the following claims.

What is claimed is:

1. In a slide fastener for use with an article wherein the slide fastener includes a pair of stringer tapes which carry interlockable rows of scoops along their opposed longitudinal edges and which are attached to the edges of the article bounding an opening therein, the combination thereof with an emergency opening zone which is located intermediate both ends of said rows of scoops and in which said rows of scoops are incapable of interlocking engagement when the slide fastener is closed, said tapes extending throughout said emergency opening zone to accommodate disengagement of said rows of scoops by forces applied to the tapes in said emergency opening zone, and a pair of reinforcements of relatively rigid material fixedly arranged along and on the opposite sides of said emergency opening zone and spaced from said longitudinal edges, each reinforcement being longer than said emergency opening zone and extending substantially beyond both extremities thereof and in longitudinally overlapping relation with interlockable scoops of said rows.

2. The combination of claim 1, wherein said reinforcements are sewn into the respective edges of the article bounding the opening therein.

3. The combination of claim 1, wherein said reinforcements are directly affixed to said stringer tapes respectively.

4. The combination of claim 1, wherein said emergency opening zone is formed by deforming several scoops on at least one of the stringer tapes so as to be substantially incapable of interlocking engagement with corresponding scoops when the slide fastener is closed.

* * * * *